United States Patent [19]

Rome

[11] Patent Number: 4,727,447

[45] Date of Patent: Feb. 23, 1988

[54] SAFETY SYSTEM AND METHOD

[75] Inventor: Gerald F. Rome, Houston, Tex.

[73] Assignee: Texaco Inc., White Plains, N.Y.

[21] Appl. No.: 451,708

[22] Filed: Dec. 20, 1982

[51] Int. Cl.[4] ..... G08B 13/18

[52] U.S. Cl. ..... 361/1; 340/552; 340/685

[58] Field of Search ..... 307/9, 117; 340/552, 340/685

[56] References Cited

U.S. PATENT DOCUMENTS

| | | | |
|---|---|---|---|
| 3,168,729 | 2/1965 | Volberg | 340/685 X |
| 3,745,549 | 7/1973 | Jepperson et al. | 340/685 X |
| 4,064,997 | 12/1977 | Holland et al. | 340/685 X |

*Primary Examiner*—A. D. Pellinen
*Assistant Examiner*—Todd E. DeBoer
*Attorney, Agent, or Firm*—Robert A. Kulason; Ronald G. Gillespie

[57] ABSTRACT

A safety system for use with apparatus having a conductive member and where the apparatus changes the attitude and/or altitude of the conductive member during its operation includes at least one sensor which senses an electric field and provides a signal representative of the strength of the electric field. A safety device responsive to the signal from the sensor prevents the further changing of the conductive member's attitude and/or altitude when the electric field strength is greater than a predetermined safe value.

13 Claims, 6 Drawing Figures

SAFETY SYSTEM AND METHOD

BACKGROUND OF THE INVENTION

Field of the Invention

The present invention relates to safety systems and methods in general and, more particularly, to a safety system and method for use with conductive members when used in the presence of power lines.

SUMMARY OF THE INVENTION

A safety system and method for use with apparatus having a conductive member, where said apparatus changes the attitude and/or altitude of the conductive member during the operation of the apparatus, includes at least one sensor mounted on the conductive member. The sensor will sense an electric field and provide a signal representative of the strength of the sensed electric field. Further changing of the conductive member's attitude and/or altitude is prevented in response to the signal from the sensor when the electric field strength is greater than a predetermined safe value.

The objects and advantages of the invention will appear more fully hereinafter from a consideration of the detailed description which follows, taken together with the accompanying drawings wherein one embodiment of the invention is illustrated by way of example. It is to be expressly understood, however, that the drawings are for illustration purposes only and are not to be construed as defining the limits of the invention.

DESCRIPTION OF THE INVENTION

There have been fatal accidents in the oil field with drilling and with well service groups due to raising derricks and masts of drilling and workover rigs into electrical power lines. This safety problem is not unique to the oil industry but is also applicable to other industries where devices such as cherry pickers used by power companies, tree surgeons, plus construction cranes and other conductive masts or devices, accidentally come in contact with power lines. Nor is the present invention restricted to devices located on trucks but is also applicable to a situation where a conductive member may be raised in the presence of a power line. A conductive member for purposes of the present invention is any member whose structure is conductive or whose structure is non-conductive but has other means of conduction such as wires and cables. The present invention provides a method of preventing this type of accident and at the same time warning the operator that the rig is in a hazardous situation.

Figure 1:
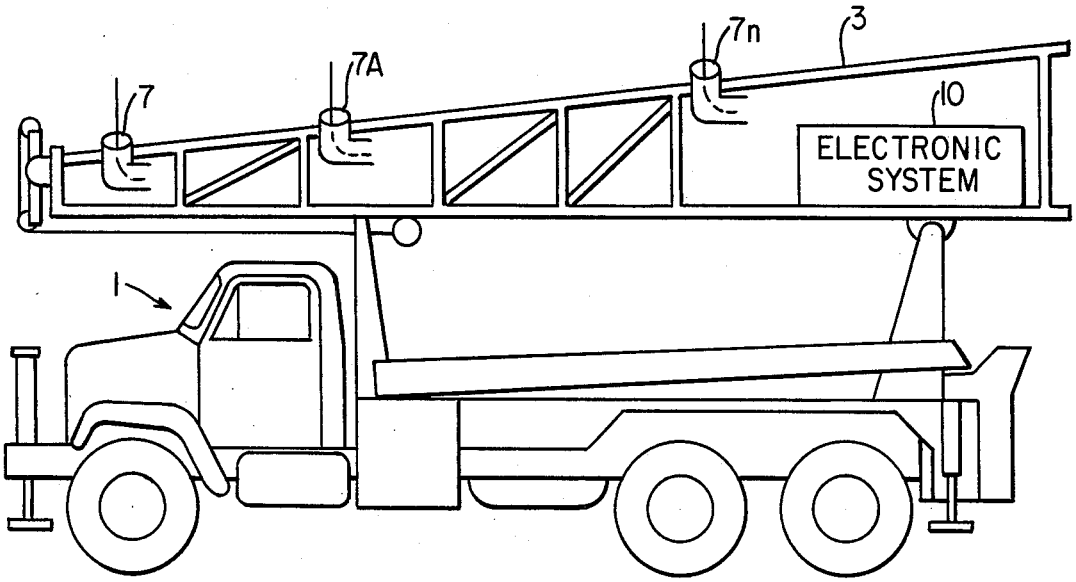
FIG. 1 is a pictorial representation of a truck mounted derrick having a safety system constructed in accordance with the present invention.
Figure 3A:
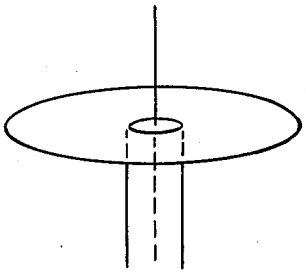
FIGS. 3A through 3D illustrate schematically different types of sensors which may be used with the present invention.
Figure 3C:
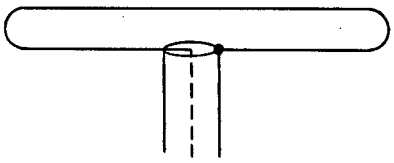
Figure 3B:
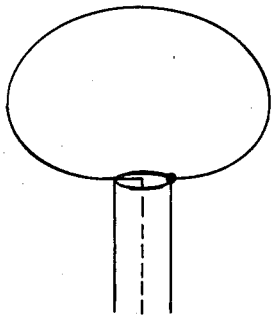
Figure 3D:
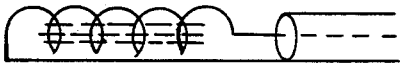

Referring now to FIG. 1, there is shown a typical service conductive member such as a derrick 3 mounted on a truck 1 which is raised to an operating position by conventional means. Located at strategic points on derrick 3 are any number of sensors represented by sensors 7, 7A, and **7*n*, which are electrically connected to an electronic system 10. As derrick 3 is raised during normal operation and it approaches power lines, sensors 7 through 7*n* will have voltages induced by the electric field created by the power lines and provides signals to electronic systems 10. When the electric field is strong enough electronic systems 10 will stop the raising of derrick 3** and sound an alarm audibly and visibly as hereinafter explained.

Figure 2:
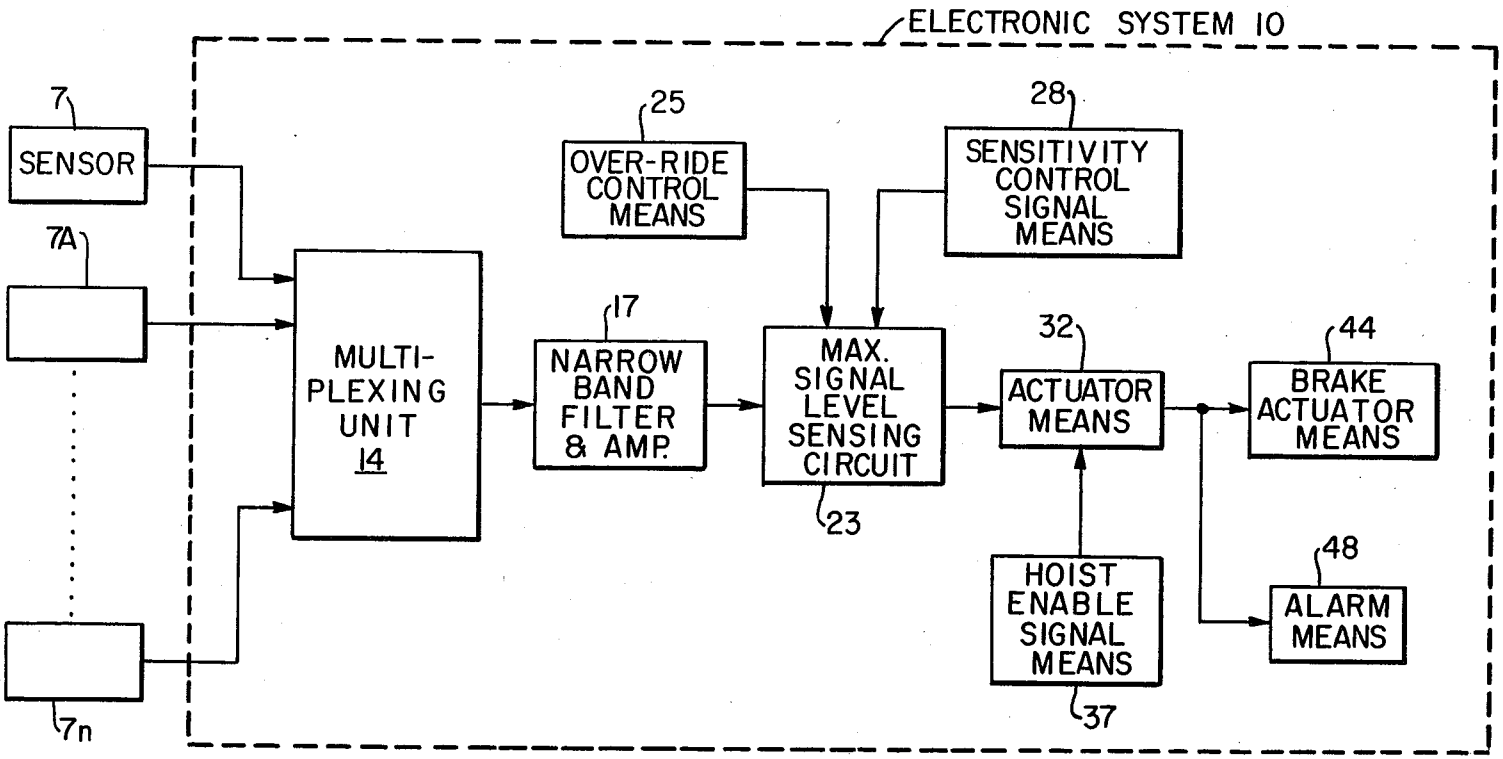
FIG. 2 is a simplified block diagram of the safety system shown in FIG. 1.

With reference to FIG. 2, sensors 7 through **7*n* in the presence of an electric field provides signals to a multiplexing unit 14 of electronics system 10 which multiplexes the signals to approximately 1 second samples. The multiplexed signal is then provided to a narrow band filter and amplifier 17 which filters the multiplexed signal so that only a signal associated with the power lines is provided to a maximum signal level circuit 23. Circuit 23 is of a conventional type and its detail is not necessary to an understanding of the present invention. Maximum signal level circuit 23 may be overriden by an override signal from an override signal means 25 which may be a simple on/off switch receiving a direct current voltage for application to the maximum signal sensing circuit 23. A sensitivity control signal means provides a signal to maximum signal level circuit 23 for adjusting the sensitivity of maximum signal level circuit 23. Maximum signal level sensing circuit 23 provides a brake signal to actuator means 32, which is part of the conventional raising means, which also receives a hoist enable signal from hoist enable signal means 37 when derrick 3 is being raised. The brake signal from actuator means 32 is provided to brake actuator means 44 and to alarm means 48. Alarm means 48** may provide either an audio alarm, a visual alarm or both.

In operation, an operator wishing to raise derrick 3 causes hoist enable signal means 37 to provide a hoist enable signal to actuator means 32 which raises derrick 3. When derrick 3 approaches a power line, the electric field around that power line causes sensors 7 through **7*n* to provide signals to multiplexing unit 14 having amplitudes corresponding to the intensity of the electric field. Multiplexing unit 14 provides a multiplexed signal to narrow band filter and amplifier 17 which in turn provides the filtered signal to maximum signal level circuit 23. Any one of the sensors 7 through 7*n* providing a signal that is greater than a predetermined safety level causes maximum signal level circuit 23 to provide a signal to actuator means 32 disabling actuator means 32 and causing actuator means 32 to provide the brake signal to brake actuator means 44 and alarm means 48. Brake actuator means 44 stops the movement of derrick 3, while alarm means 48 sounds an alarm that derrick 3 has approached a power line. Should sensors 7 through 7*n* provide such a signal and the operator in his judgment can see that he can safely raise derrick 3 in the presence of the power line with safety, he may then utilize override contol means 25 to provide an override signal to maximum signal level sensing circuit 23 which then is deactivated to allow actuator means 32 to continue to raise derrick 3. The operator would also use the override signal when lowering derrick 3** after the derrick has entered a strong electric field.

Although the system of the present invention has been shown as having multiple sensors, a single sensor appropriately placed on derrick 3 may also be utilized in which case multiplexing unit 14 would not be necessary and the signal from the single sensor may be applied directly to narrow band filter and amplifier 17.

FIGS. 3A, 3B, 3C and 3D show different types of configurations for sensors 7, although the specific configuration of sensor 7 is not restricted to any one of four types shown, but is restricted to a sensor which will produce a signal in the presence of an electric field that is representative of the strength of the electric field.

The present invention as hereinbefore described is a safety system for use with an aerial truck which utilizes a derrick or a conductive structure which is raised from one position to another position during the course of operation and which may come into contact with electric power lines and cause injury and death to the operators of such apparatus.

What is claimed is:

1. A safety system for use with apparatus having a conductive member, said apparatus changes the attitude and/or altitude of the conductive member during operation of the apparatus, comprising:

means mounted on the conductive member for sensing an electric field and providing a signal representative of the strength of the electric field, alarm means connected to the sensing means and responsive to the signal from the sensing means for providing an alarm when the conductive member has entered an electric field whose strength is greater than a predetermined safe value, and sensitivity means for controlling the sensitivity of the alarm means; and wherein the sensing means includes:

a plurality of sensors located at predetermined sites on the conductive member, each sensor being of the type where an electric field induces a voltage in the sensor whose amplitude corresponds to the strength of the electric field, said sensor provides the induced voltage as a signal, and multiplexing means connected to the plurality of sensors and to the preventing means for multiplexing the signals from the plurality of sensors to provide a multiplexed signal to the preventing means.

2. A safety system as described in claim 1 in which the conductive member has one end at a fixed position and the other end may be raised to a higher level or lowered from a higher level, and the sensor is mounted on the conductive member at or near the movable end of the conductive member.

3. A safety system as described in claim 2 wherein the apparatus includes:

actuator means for moving the conductive member in such a manner so as to change the attitude and/or altitude of the conductive member in response to a hoist signal, means connected to the actuator means for providing the hoist signal to the actuator means in response to activation by an operator, and brake actuator means responsive to a brake signal from the actuator means for braking the movement of the conductive member so as to prevent a further change in attitude; and wherein the preventing means includes maximum signal level means connected to the sensing means for providing a control signal to the actuator means when the signal from the sensing means exceeds a predetermined level so as to prevent the actuator means from moving the conductive member and to cause the actuator means to provide the brake signal to the brake actuator means.

4. A safety system as described in claim 3 in which the preventing means further includes:

filter means connected between the multiplexing means and the maximum signal level means for filtering the multiplexed signal from the multiplexing means so as to provider a signal having a frequency associated with the electric field.

5. A safety system as described in claim 4 further comprising:

alarm means connected to the actuator means and responsive to the brake signal for providing an alarm to the operator of the apparatus warning him that the conductive member has entered an electric field whose strength is greater than the predetermined safe value.

6. A method for safely changing the attitude and/or altitude of a conductive member in the vicinity of a power line comprising the steps of:

mounting a plurality of sensors at predetermined locations on the conductive member, each sensor providing a signal when in the presence of an electric field representative of the strength of the electric field at the sensor's location, multiplexing the signal from the sensors to provide a multiplexed signal, moving the conductive member in accordance with the multiplexed signal until either the conductive member arrives at a desired attitude and/or altitude for the conductive member or a sensor provides a signal that the conductive member has entered an electric field whose strength is greater than the predetermined safe value.

7. A method as described in claim 6 in which the moving step includes:

determining a maximum signal level from the sensor, providing a reference signal representative of the predetermined safe value for the electric field, adjusting the reference signal level for sensitivity, stopping the erecting of the conductive member and providing a brake signal representative of an unsafe condition when the maximum signal level is greater than the adjusted predetermined reference signal level, and braking the movement of the conductive member in response to the brake signal.

8. A method as described in claim 7 further comprising:

providing an alarm in response to the occurrence of a brake signal.

9. A method as described in claim 8 in which the alarm is both audio and visible.

10. A safety system for use with apparatus having a conductive member, said apparatus changes the attitude and/or altitude of the conductive member during operation of the apparatus, comprising:

sensing means mounted on the conductive member for sensing an electric field and providing a signal representative of the strength of the electric field, alarm means connected to said sensing means and responsive to the signal from the sensing means for providing an alarm when the conductive member has entered an electric field whose strength is greater than a predetermined safe value, and sensitivity means for controlling the sensitivity of the alarm means; and wherein the sensing means includes:

a plurality of sensors located at predetermined sites on the conductive member, each sensor being of the type where an electric field induces a voltage in the sensor whose amplitude corresponds to the strength of the electric field, said sensor provides the induced voltage as a signal, and multiplexing means connected to the plurality of sensors and to the alarm means for multiplexing the signals from the plurality of sensors to provide a multiplexed signal to the alarm means.

11. A safety system as described in claim 10 in which the conductive member has one end at a fixed position and the other end may be raised to a higher level or lowered from a higher level, and the sensor is mounted on the conductive member at or near the movable end of the conductive member.

12. A safety system as described in claim 11 in which the alarm means includes:

maximum signal level means connected to the sensor for providing a warning signal when the signal from the sensor exceeds a predetermined level, and an alarm device connected to the maximum signal level means is responsive to the occurrence of a warning signal to provide the alarm.

13. A safety system as described in claim 12 in which the alarm means further includes:

filter means connected between the multiplexing means and the maximum signal level means for filtering the multiplexed signal from the multiplexing means so as to provide a signal having a frequency associated with the electric field.

* * * * *